US007870890B2

(12) United States Patent
Liu

(10) Patent No.: US 7,870,890 B2
(45) Date of Patent: Jan. 18, 2011

(54) HEAT DISSIPATION DEVICE WITH HEAT PIPE

(75) Inventor: Peng Liu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 538 days.

(21) Appl. No.: 11/953,731

(22) Filed: Dec. 10, 2007

(65) Prior Publication Data

US 2009/0145588 A1 Jun. 11, 2009

(51) Int. Cl.

| | |
|---|---|
| ***F28D 15/00*** | (2006.01) |
| ***H05K 7/20*** | (2006.01) |
| ***H01L 23/34*** | (2006.01) |
| ***F28F 7/00*** | (2006.01) |

(52) U.S. Cl. ..... 165/104.33; 165/80.3; 361/700; 257/715

(58) Field of Classification Search ..... 165/104.33; 361/700

See application file for complete search history.

(56) References Cited

U.S. PATENT DOCUMENTS

| | | | | |
|---|---|---|---|---|
| 6,918,429 | B2 * | 7/2005 | Lin et al. | 165/80.3 |
| 7,443,677 | B1 * | 10/2008 | Zhou et al. | 361/702 |
| 7,548,426 | B2 * | 6/2009 | Liu | 361/700 |
| 2003/0019610 | A1 * | 1/2003 | Liu | 165/80.3 |
| 2005/0141198 | A1 | 6/2005 | Lee et al. | |
| 2005/0183848 | A1 * | 8/2005 | Cheng et al. | 165/104.33 |
| 2006/0054307 | A1 * | 3/2006 | Lee et al. | 165/80.3 |
| 2006/0144572 | A1 * | 7/2006 | Yu et al. | 165/104.33 |
| 2007/0000646 | A1 * | 1/2007 | Chen et al. | 165/104.33 |
| 2007/0012428 | A1 * | 1/2007 | Wu et al. | 165/104.33 |
| 2008/0236798 | A1 * | 10/2008 | Zheng et al. | 165/104.33 |
| 2008/0316707 | A1 * | 12/2008 | Liu | 361/700 |

FOREIGN PATENT DOCUMENTS

CN 101115368 A * 1/2008

* cited by examiner

*Primary Examiner*—Cheryl J Tyler
*Assistant Examiner*—Brandon M Rosati
(74) *Attorney, Agent, or Firm*—Jeffrey T. Knapp

(57) ABSTRACT

A heat dissipation device includes a base for thermally engaging with an electronic device, a fin assembly including of multiple fins, a first heat pipe and a second heat pipe. The first heat pipe includes two evaporation sections engaged in the base, two interconnecting condensation sections parallel to the evaporation sections and respectively thermally inserted in a central portion of the fin assembly, and two connecting sections interconnecting corresponding condensation sections and the evaporation sections. The second heat pipe includes two evaporation sections engaged in the base, two interconnecting condensation sections parallel to the evaporation sections and respectively thermally inserted in an upper portion of the fin assembly far away from the base, and two connecting sections interconnecting corresponding condensation sections and evaporation sections of the second heat pipe.

13 Claims, 5 Drawing Sheets

HEAT DISSIPATION DEVICE WITH HEAT PIPE

BACKGROUND OF THE INVENTION

1. Field of the Invention

The present invention relates to heat dissipation devices, and particularly to a heat dissipation device having a heat pipe for cooling an electronic component, such as an integrated circuit package.

2. Description of Related Art

Electronic components, such as central processing units (CPUs) comprise numerous circuits operating at high speed and generating substantial heat. Under most circumstances, it is necessary to cool the CPUs in order to maintain safe operating conditions and assure that the CPUs function properly and reliably. In the past, various approaches have been used to cool electronic components. Typically, a finned metal heat sink is attached to an outer surface of the CPU to remove the heat therefrom. The heat absorbed by the heat sink is then dissipated to ambient air. The related finned metal heat sink is made of highly heat-conductive metal, such as copper or aluminum, and generally comprises a base for contacting the CPU to absorb the heat therefrom and a plurality of fins formed on the base for dissipating the heat. However, as the operating speed of electronic components has increased markedly in recent years, such a related heat sink, which transfers the heat only by metal conduction, is not competent for dissipating so much heat any more. The heat of the bottom of the metal heat sink can not be transferred to the whole heat dissipation device quickly, and especially can not be transferred to the fins far away from the bottom of the metal heat sink.

Heat pipes, which operate by phase change of working liquid sealed in a hollow pipe, have been widely used due to their excellent heat transfer properties. Accordingly, heat dissipation devices equipped with heat pipes are devised in various manners and widely used. How to enable the heat dissipation device equipped with heat pipes to have an optimal performance becomes a goal that persons skilled in the art endeavor to achieve.

Accordingly, what is needed is a heat dissipation device with heat pipes which has an enhanced heat dissipation performance.

SUMMARY OF THE INVENTION

A heat dissipation device includes a base for thermally engaging with an electronic device, a base for thermally engaging with the heat generating electronic device, a fin assembly consisting of a plurality of fins arranged on the base, a first heat pipe and a second heat pipe. The first heat pipe comprises two evaporation sections engaged in the base, two interconnecting condensation sections parallel to the evaporation sections and respectively thermally inserted in the central portion of the fin assembly, and two connecting sections interconnecting corresponding condensation sections and the evaporation sections. The second heat pipe comprising two evaporation sections engaged in the base, two interconnecting condensation sections parallel to the evaporation sections and respectively thermally inserted in the upper portions of the fin assembly far away from the base, and two connecting sections interconnecting corresponding condensation sections and evaporation sections of the second heat pipe. The heat produced by the electronic device is transferred to the central portion and upper portions of the fin assembly via the first and second heat pipes, thus, the present invention can enhance the heat dissipation capability of the heat dissipation device.

Other advantages and novel features of the present invention will become more apparent from the following detailed description when taken in conjunction with the accompanying drawings.

BRIEF DESCRIPTION OF THE DRAWINGS

Many aspects of the present heat dissipation device can be better understood with reference to the following drawings. The components in the drawings are not necessarily drawn to scale, the emphasis instead being placed upon clearly illustrating the principles of the present heat dissipation device. Moreover, in the drawings, like reference numerals designate corresponding parts throughout the several views.

DETAILED DESCRIPTION OF THE INVENTION

Figure 1:
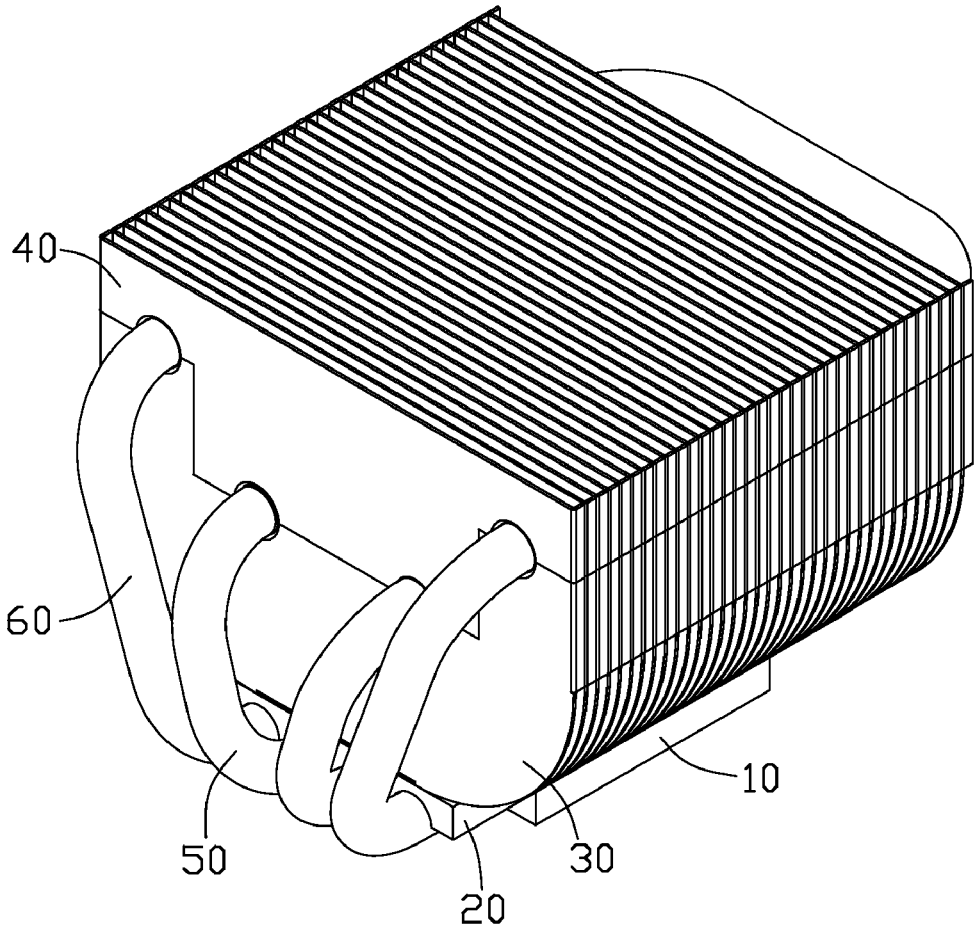
FIG. 1 is an assembled, isometric view of a heat dissipation device in accordance with a preferred embodiment of the present invention.
Figure 2:
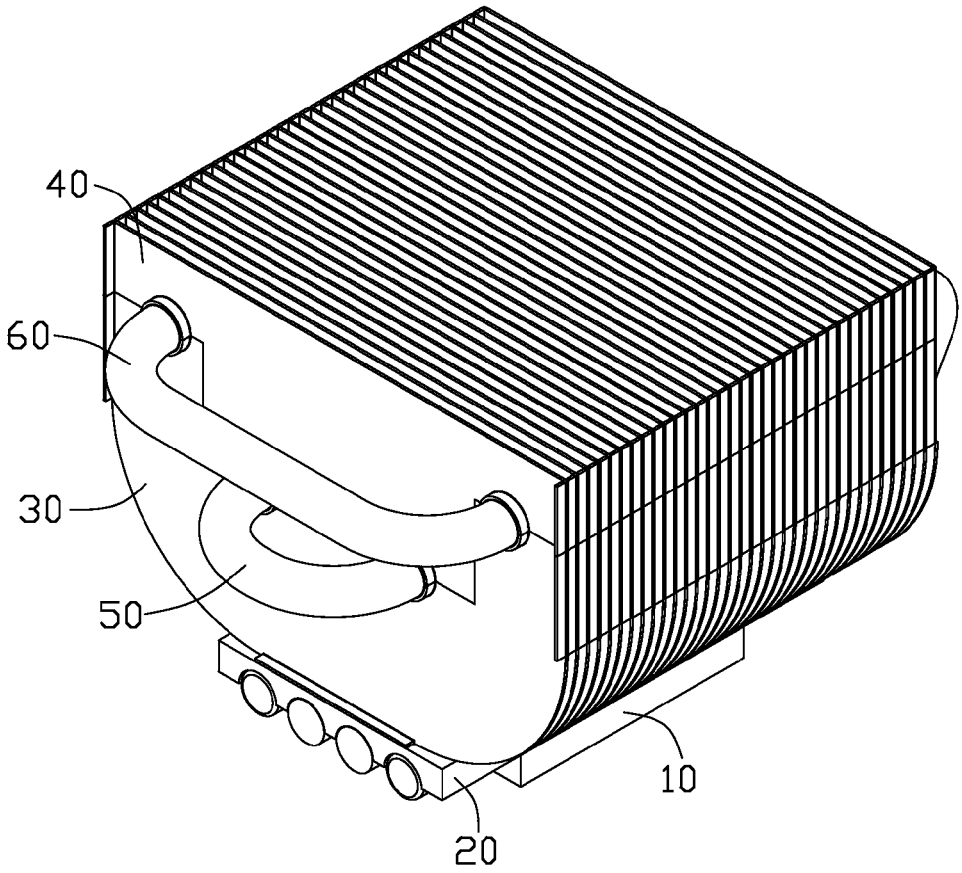
FIG. 2 shows the heat dissipation device of FIG. 1 from another aspect.

Referring to FIGS. 1-2, a heat dissipation device of a preferred embodiment of the invention comprises a base 10, a heat spreader 20 mounted on the base 10, a fin assembly comprising a first fin assembly 30 and a second fin assembly 40, and a first heat pipe 50, a second heat pipe 60 thermally connecting the base 10, the heat spreader 20 and the first and second fin assemblies 30, 40.

Figure 3:
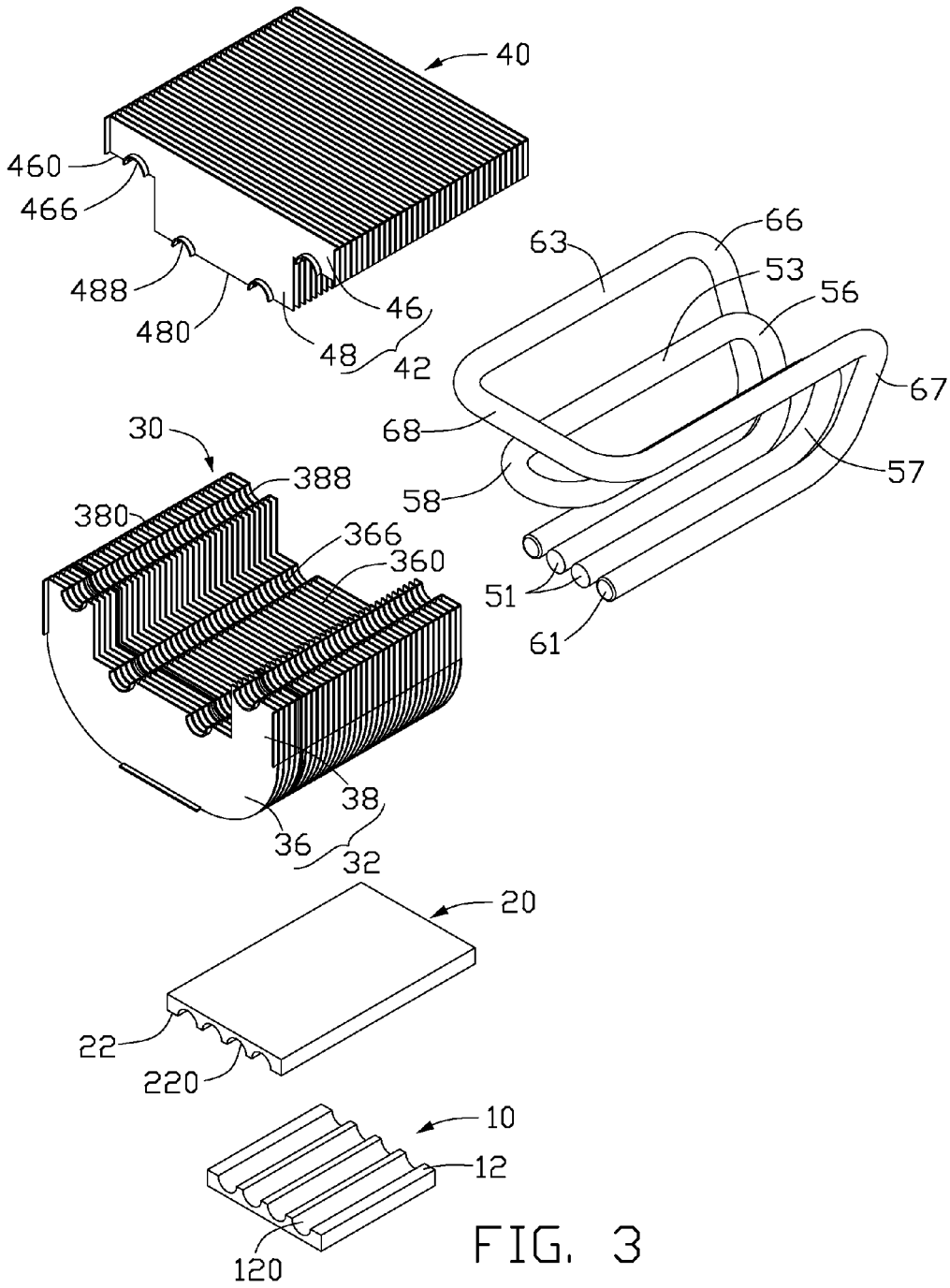
FIG. 3 is an exploded view of FIG. 2.

Referring to FIG. 3, the base 10 is a rectangular metal plate having good heat conductivity, and has a flat bottom face (not labeled) for contacting with an electronic device (not shown) on a printed circuit board (not shown) and a top face 12 on an opposite side to the bottom face. Four adjoining grooves 120 are defined in the base 10 at the top face 12 for receiving the heat pipes 50, 60 therein. The grooves 120 are straight and parallel to each other.

The heat spreader 20 is a rectangular metal plate having good heat conductivity, and has a flat top face (not labeled) and a bottom face 22 engaged with the top face 12 of the base 10. The heat spreader 20 has a width same as that of the base 10 and a length longer than that of the base 10. Four adjoining grooves 220 are defined in the spreader 20 at the bottom face 22 corresponding to the grooves 120 of the base 10. Thus, the grooves 120 and the grooves 220 cooperatively define four channels (not labeled) for receiving the heat pipes 50, 60 therein. Alternatively, the base 10 and the heat spreader 20 can be instead of an integrative base defining through holes for receiving the heat pipes 50, 60 in other embodiments of the invention.

The first fin assembly 30 comprises a plurality of parallel first fins 32 vertically standing on the top face of the spreader 20. Each first fin 32 is made from a thin metal sheet and has a U-shaped configuration. The first fin assembly 30 comprises a body 36 and two shoulders 38 upwardly and perpendicularly extending from two lateral portions of the body 36. The body 36 has a first contacting face 360 at a central upper portion and defines a pair of separate slots 366 at the first contacting face 360. Each shoulder 38 has a second contacting face 380 defined above the first contacting face 360 and defines a slot 388 at the second contacting face 380. The slots 388 of the shoulders 38 are parallel to the slots 366 of the body 36. Flanges (not labeled) perpendicularly extend from bottom edges, lateral edges and the slots 366, 388 of the first fins 32. The flanges separate the fins 320 at uniform intervals and form a flat bottom face of the first fin assembly 30.

The second fin assembly 40 is mounted on the first fin assembly 30 and comprises a plurality of parallel second fins 42. The second fin assembly 40 has a configuration which is complementary with respect to the first fin assembly 40. Each second fin 42 is made from a thin metal sheet and has a T-shaped configuration. The second fin assembly 40 comprises a body 46 and a projection 48 downwardly and perpendicularly extending from a central portion of the body 46. The projection 48 has a first contacting face 480 at the bottom thereof and defines a pair of separate slots 488 at the first contacting face 480 corresponding to the slots 366 of the first fin assembly 30. The body 46 has two second contacting faces 460 at two lateral bottoms thereof defined above the first contacting face 480 and defines two slots 466 respectively at the second contacting faces 460 corresponding to the slots 388 of the first fin assembly 30. Flanges (not labeled) perpendicularly extend from lateral edges and the slots 466, 488 of the second fins 42. The flanges separate the fins 42 at uniform intervals.

The first heat pipe 50 is bent to have two coplanar evaporation sections 51, and two coplanar condensation sections 53. The condensation sections 53 are located above the evaporation sections 51. The evaporation sections 51 are parallel and adjoining to each other. The condensation sections 53 are spaced from each other, and parallel to the evaporation sections 51. The two evaporation sections 51 respectively interconnect the two condensation sections 53 via two slantwise connecting sections 56, 57. An acute angle is formed between the connecting sections 56, 57. A connecting section 58 interconnects the condensation sections 53 and is coplanar with the condensation sections 53 in a manner such that an upper portion of the first heat pipe 50 has a U-shaped configuration respectively at top and side surfaces.

The second heat pipe 60 is similar to the first heat pipe 50 and comprises two evaporation sections 61 located at two flanks of and adjoining to the evaporation sections 51 of the first heat pipe 50, and two spaced condensation sections 63 located above the condensation sections 53 of the first heat pipe 50. The two evaporation sections 61 respectively interconnect the two condensation sections 63 via two slantwise first connecting sections 66, 67 via two slantwise connecting sections 66, 67. A connecting section 68 interconnects the condensation sections 63 in a manner such that an upper portion of the first heat pipe 60 has a U-shaped configuration respectively at top and side surfaces. The evaporation sections 61 are coplanar with the evaporation sections 51 of the first heat pipe 50 and sandwich them. The condensation sections 63 are coplanar with each other and located above the condensation sections 53 of the first heat pipe 50. A distance between the condensation sections 63 of the second heat pipe 60 is larger than a distance between the condensation sections 53 of the first heat pipe 50.

Figure 4:
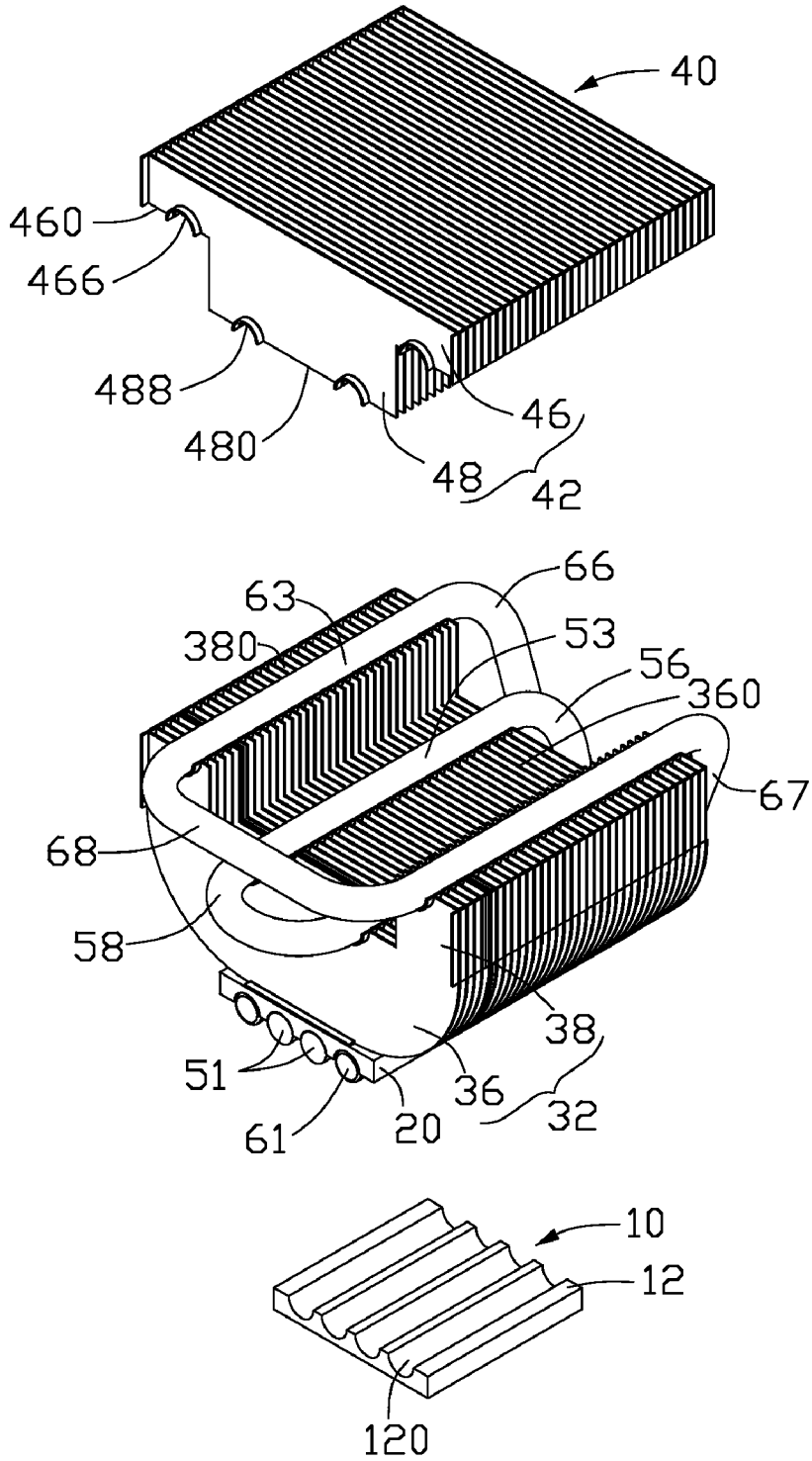
FIG. 4 is a partially assembled view of FIG. 3.
Figure 5:
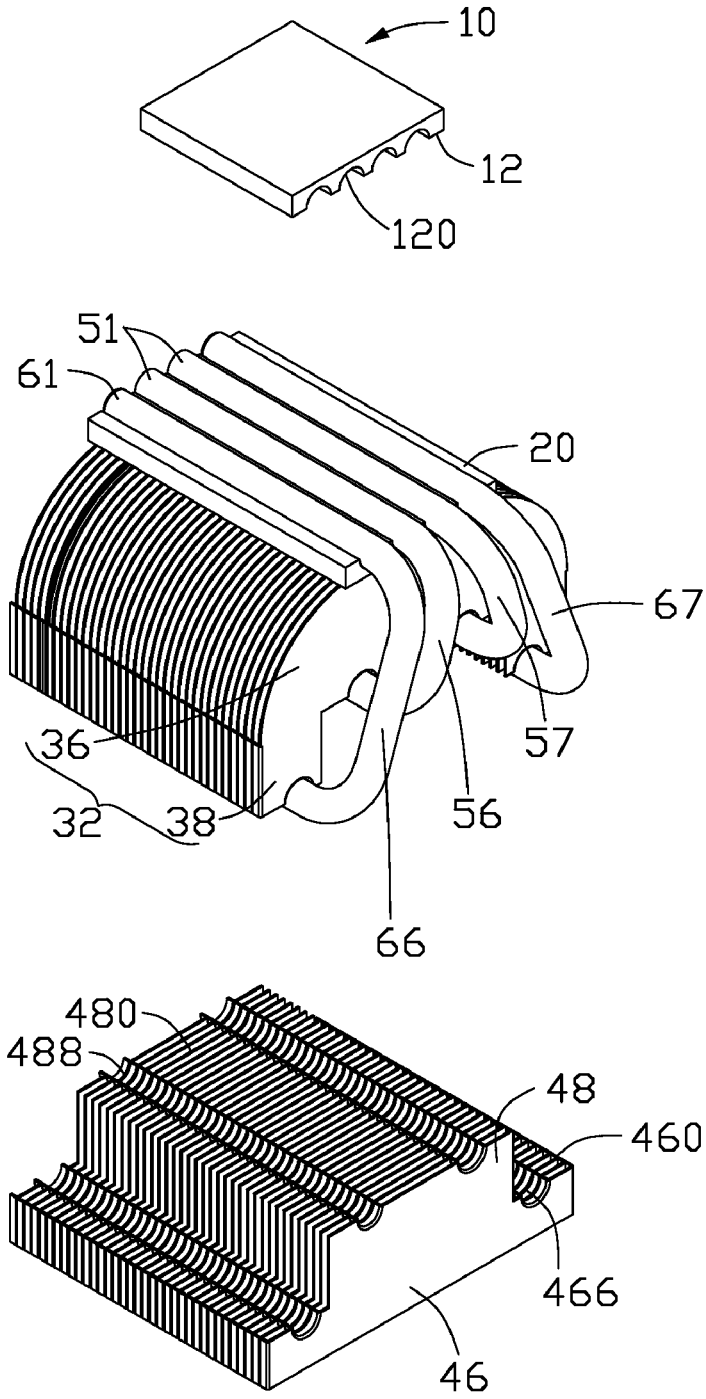
FIG. 5 is an inverted view of FIG. 4.

Referring to FIGS. 4-5, in assembly of the heat dissipation device, the heat spreader 20 and the base 10 are soldered together and sandwich the evaporation sections 51, 61 of the heat pipes 50, 60 therebetween. The evaporation sections 51, 61 are thermally engaged in the channels defined by the grooves 120, 220 of the base 10 and the heat spreader 20. The first fin assembly 30 is mounted on the top face of the spreader 20. The second fin assembly 40 thermally engages with the first fin assembly 30. The projection 48 of the second fin assembly 40 is located between the shoulders 38 of the first fin assembly 30. The first contacting face 480 of the projection 48 engages with the first contacting face 360 of the body 36. The condensation sections 53 are sandwiched between first contacting face 360, 480. The condensation sections 53 of the first heat pipe 50 are received in channels defined by the slots 366, 488. The second contacting faces 460 of the body 46 engage with the second contacting faces 380 of the shoulders 38. The condensation sections 63 of the second heat pipe 60 are received in channels (not labeled) defined by the slots 388, 466.

In use of the heat dissipation device, the base 10 absorbs heat from the electronic device to which the base 10 is attached. A part of the heat in the base 10 is absorbed by the heat spreader 20 and directly transferred to a bottom of the first fin assembly 40. Another part of the heat in the base 10 is absorbed by the evaporation sections 51 of the first heat pipe 50 and is then transferred to a central portion of the fin assembly via the connecting sections 56, 57 and the condensation sections 53 of the first heat pipe 50. The last part of the heat in the base 10 is absorbed by the evaporation sections 61 of the second heat pipe 60 and is then transferred to upper portions of the fin assembly far away from the base 10 via the connecting sections 66, 67 and the condensation sections 63 of the heat pipe 60. The heat in the first and second fins 240, 260 is subsequently dissipated to ambient air.

In the present invention, since each of the first and the second heat pipe 50, 60 is bent by an integrative straight heat pipe, the first and second heat pipes 50, 60 of the present invention can function generally equal to four U-shaped heat pipes regarding the heat transferring capability. Thus, the present invention can enhance the heat dissipation capability of the heat dissipation device without increase the number of the heat pipes. Accordingly, cost of the heat dissipation device according to the present invention can be lowered. Furthermore, the condensation sections 53, 63 of the heat pipes 50, 60 are assembled to the heat dissipation device via the first and second fin assemblies 30, 40 perpendicularly sandwiching condensation sections 53, 63 therebetween instead of inserting a heat pipe through a single fin assembly as the conventional art did. Accordingly, assembly of the heat dissipation device according to the present invention can be simplified and cost thereof can be lowered, in comparison with a conventional heat dissipation device having the same heat dissipation capability.

Alternatively, in another embodiment, the first fin assembly can have a T-shaped configuration and the second fin assembly can have a U-shaped configuration, thus the second contacting faces of the first and second fin assemblies can be defined between the first contacting faces of the first and second fin assemblies.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat dissipation device for removing heat from a heat generating electronic device, the heat dissipation device comprising:

a base adapted for thermally and physically engaging with the heat generating electronic device;

a fin assembly consisting of a plurality of fins;

a first heat pipe comprising two evaporation sections thermally and physically engaged in the base, two interconnecting condensation sections parallel to the evaporation sections and respectively thermally and physically inserted in a central portion of the fin assembly, and two connecting sections interconnecting corresponding condensation sections and the evaporation sections, the two condensation sections of the first heat pipe defining a first plane substantially parallel to the base; and a second heat pipe comprising two evaporation sections thermally and physically engaged in the base, two interconnecting condensation sections parallel to the evaporation sections and respectively thermally and physically inserted in an upper portion of the fin assembly far away from the base, and two connecting sections interconnecting corresponding condensation sections and evaporation sections of the second heat pipe, the two condensation sections of the second heat pipe defining a second plane substantially parallel to the base, the first plane being located between the base and the second plane.

2. The heat dissipation device as described in claim 1, further comprising a heat spreader coupled to the base, the evaporation sections of the first and second heat pipes being sandwiched between the base and the heat spreader, the fin assembly standing on the heat spreader.

3. The heat dissipation device as described in claim 1, wherein a distance between the condensation sections of the second heat pipe is larger than a distance between the condensation sections of the first heat pipe.

4. The heat dissipation device as described in claim 3, wherein the evaporation sections of the first heat pipe are coplanar with the evaporation sections of the second heat pipe, a plane defined by the evaporation sections of the first and second heat pipes being parallel to the first plane and the second plane.

5. The heat dissipation device as described in claim 1, wherein the connecting sections of the first heat pipe slantwise extend from the evaporation sections of the first heat pipe and are at an angle to each other.

6. The heat dissipation device as described in claim 1, wherein the first heat pipe comprises an upper portion at which the condensation sections of the first heat pipe is located and a lower portion at which the evaporation sections of the first heat pipe is located, the upper portion having a U-shaped configuration and being substantially parallel to the base.

7. The heat dissipation device as described in claim 1, wherein the connecting sections of the second heat pipe slantwise extend from the evaporation sections of the second heat pipe and are at an angle to each other.

8. The heat dissipation device as described in claim 1, wherein the second heat pipe comprises an upper portion at which the condensation sections of the second heat pipe is located and a lower portion at which the evaporation sections of the second heat pipe is located, the upper portion having a U-shaped configuration and being substantially parallel to the base.

9. The heat dissipation device as described in claim 2, wherein the fin assembly comprise a first fin assembly mounted on the heat spreader and a second fin assembly mounted on the first fin assembly, the first and second fin assembly having first contacting faces engaged with the condensation sections of the first heat pipe, the first and second fin assembly having second contacting faces engaged with the condensation sections of the second heat pipe, the first contacting faces being closer to the base than the second contacting faces.

10. The heat dissipation device as described in claim 9, wherein the first fin assembly has a U-shaped configuration and the second fin assembly has a T-shaped configuration.

11. A heat sink assembly, comprising:

a heat spreader;

a base thermally and physically engaging with the heat spreader;

a plurality of fins mounted on the heat spreader; and a heat pipe assembly having evaporating sections sandwiched between the heat spreader and the base the evaporating sections thermally and physically engaging the base, and a U-shaped first condensation section extending through the fins and a U-shaped second condensation section extending through the fins, the U-shaped first condensation section and the U-shaped second condensation section being substantially parallel to each other and substantially parallel to the base, the U-shaped first condensation section being located between the U-shaped second condensation section and the base, the U-shaped first condensation section and the U-shaped second condensation section thermally and physically engaging the fins.

12. The heat sink assembly of claim 11, wherein the plurality of fins comprises a plurality of first fins directly arranged on the heat spreader and a plurality of second fins arranged on the first fins, the first fins each have a T-shaped configuration, and the second fins each have a U-shaped configuration.

13. The heat sink assembly of claim 12, wherein the first fins form a first contacting face and a second contacting face further from the base than the first contacting face, the second fins forming a first contacting face coupled to the first contacting face of the first fins and a second contacting face coupled to the second contacting face of the first fins, the first contacting faces of the first and second fins being defined between the second contacting faces of the first and second fins, the U-shaped first condensation section being attached to the first contacting faces, and the U-shaped second condensation section being attached to the second contacting faces.

* * * * *